US011325133B1

(12) United States Patent
Tracy et al.

(10) Patent No.: US 11,325,133 B1
(45) Date of Patent: May 10, 2022

(54) SYSTEMS AND METHODS FOR MONITORING THE ROLL DIAMETER AND SHOCK LOADS IN A MILLING APPARATUS

(71) Applicant: PEARSON INCORPORATED, Sioux Falls, SD (US)

(72) Inventors: Josh Tracy, Harrisburg, SD (US); Alex Pearson, Sioux Falls, SD (US); Roy Olson, Sioux Falls, SD (US)

(73) Assignee: Pearson Incorporated, Sioux Falls, SD (US)

( * ) Notice: Subject to any disclaimer, the term of this patent is extended or adjusted under 35 U.S.C. 154(b) by 187 days.

(21) Appl. No.: 16/514,450

(22) Filed: Jul. 17, 2019

Related U.S. Application Data

(60) Provisional application No. 62/703,682, filed on Jul. 26, 2018.

(51) Int. Cl.
*B02C 25/00* (2006.01)
*B02C 4/42* (2006.01)
*B02C 4/02* (2006.01)

(52) U.S. Cl.
CPC ..... *B02C 25/00* (2013.01); *B02C 4/02* (2013.01); *B02C 4/42* (2013.01); *B02C 2210/01* (2013.01)

(58) Field of Classification Search
CPC .... B02C 4/00; B02C 4/02; B02C 4/28; B02C 4/32; B02C 4/42; B02C 25/00
See application file for complete search history.

(56) References Cited

U.S. PATENT DOCUMENTS

| | | | |
|---|---|---|---|
| 254,974 | A | 3/1882 | Hollingsworth |
| 417,836 | A | 12/1889 | Ponsar |
| 454,950 | A | 6/1891 | Sewell |
| 473,957 | A | 5/1892 | Pollock |
| 621,744 | A | 3/1899 | Bowden |
| 664,836 | A | 1/1901 | Davidson |
| 738,166 | A | 9/1903 | Davidson |

(Continued)

FOREIGN PATENT DOCUMENTS

| | | |
|---|---|---|
| CN | 207385669 | 5/2018 |
| DE | 4216807 | 11/1993 |

(Continued)

OTHER PUBLICATIONS

Charles Stark and Julie Kalivoda, "Evaluating Particle Size of Feedstuffs", publication, Nov. 2016, 4 pages, K-State Research and Extension, Kansas State University Agricultural Experiment Station and Cooperative Extension Services, Manhattan, Kansas.

*Primary Examiner* — Matthew Katcoff
(74) *Attorney, Agent, or Firm* — Jeffrey A. Proehl; Woods, Fuller, Shultz & Smith, PC

(57) ABSTRACT

Systems and methods for monitoring the roll diameter and shock loads in a milling apparatus may include a frame, a pair of rolls including a movable first roll and a stationary second roll, roll supports configured to support the first roll on the frame in a movable manner and the second roll on the frame in a stationary manner, and a motor assembly configured to rotate at least one of the rolls. Embodiments of the systems may also include a wear sensing assembly configured to detect wear on at least one of the rolls of the pair of rolls. Embodiments of the systems may also include a shock sensing assembly configured to detect shock to at one of the rolls.

17 Claims, 10 Drawing Sheets

(56) References Cited

U.S. PATENT DOCUMENTS

| | | | |
|---|---|---|---|
| 1,466,508 | A | 8/1923 | Lake |
| 1,568,267 | A | 1/1926 | Carter |
| 1,611,675 | A | 12/1926 | Prestmon |
| 2,053,038 | A | 9/1936 | Mackenzie |
| 2,118,010 | A | 5/1938 | Hazle, Jr. |
| 3,226,041 | A | 12/1965 | Graumann |
| 3,304,355 | A | 2/1967 | Pobst, Jr. |
| 3,362,649 | A | 1/1968 | Odden |
| 3,683,559 | A | 8/1972 | Kalwaites |
| 3,752,315 | A | 8/1973 | Hubach |
| 4,044,580 | A | 8/1977 | Worden |
| 4,165,280 | A | 8/1979 | Holley |
| 4,177,900 | A | 12/1979 | Kluthe |
| 4,202,192 | A | 5/1980 | Haneda |
| 4,202,629 | A | 5/1980 | Jakobs |
| 4,213,855 | A | 7/1980 | Vonbennigsen-Mackiewicz |
| 4,295,420 | A | 10/1981 | Satake |
| 4,361,476 | A | 11/1982 | Brewer |
| 4,387,552 | A | 6/1983 | Lancaster |
| 4,442,876 | A | 4/1984 | Koike |
| 4,468,265 | A | 8/1984 | Maclaughlin |
| 4,608,156 | A | 8/1986 | Reddish |
| 4,645,484 | A | 2/1987 | Niske |
| 4,786,001 | A | 11/1988 | Ephraim |
| 4,862,570 | A | 9/1989 | Bald |
| 4,941,290 | A | 7/1990 | Holyoke |
| 4,986,997 | A | 1/1991 | Posner |
| 5,052,088 | A | 10/1991 | Hagewood |
| 5,100,062 | A | 3/1992 | Baltensperger |
| 5,115,984 | A | 5/1992 | Satake |
| 5,192,028 | A | 3/1993 | Curran |
| 5,201,470 | A | 4/1993 | Baltensperger |
| 5,251,144 | A | 10/1993 | Ramamurthi |
| 5,315,789 | A | 5/1994 | Takashi |
| 5,366,167 | A | 11/1994 | Mccarthy |
| 5,392,998 | A | 2/1995 | Suessegger |
| 5,433,391 | A | 7/1995 | Jagger |
| 5,501,629 | A | 3/1996 | Kawana |
| 5,523,701 | A | 6/1996 | Smith |
| 5,533,371 | A | 7/1996 | Frischknecht |
| 5,581,351 | A | 12/1996 | Marcus |
| 5,717,209 | A | 2/1998 | Bigman |
| 5,870,699 | A | 2/1999 | Canada |
| 6,176,683 | B1 | 1/2001 | Yang |
| 6,199,777 | B1 | 3/2001 | Satake |
| 6,293,478 | B1 | 9/2001 | Livieri |
| 6,365,416 | B1 | 4/2002 | Elsohly |
| 6,372,281 | B1 | 4/2002 | Metzger |
| 6,443,376 | B1 | 9/2002 | Huang |
| 6,517,016 | B1 | 2/2003 | Feige |
| 6,589,598 | B2 | 7/2003 | Ochiai |
| 6,730,519 | B2 | 5/2004 | Elsohly |
| 6,990,431 | B2 | 1/2006 | Beaudoin |
| 7,006,953 | B2 | 2/2006 | Takemura |
| 7,034,711 | B2 | 4/2006 | Sakatani |
| 7,083,544 | B2 | 8/2006 | Goransson |
| 7,170,251 | B2 | 1/2007 | Huang |
| 7,183,735 | B2 | 2/2007 | Heinemann |
| 7,206,719 | B2 | 4/2007 | Lindsay |
| 7,381,017 | B2 | 6/2008 | Wang |
| 7,419,694 | B2 | 9/2008 | Korolchuk |
| 7,425,344 | B2 | 9/2008 | Korolchuk |
| 7,540,697 | B2 | 1/2009 | Wang |
| 7,568,641 | B2 | 8/2009 | Dreimann |
| 7,592,468 | B2 | 9/2009 | Goodwin |
| 7,756,678 | B2 | 7/2010 | Bonissone |
| 7,832,241 | B2 | 11/2010 | Mantovan |
| 8,144,005 | B2 | 3/2012 | Hu |
| 8,172,166 | B2 * | 5/2012 | Inoue ..... B02C 25/00 241/37 |
| 8,206,061 | B1 | 6/2012 | Hansen |
| 8,211,341 | B2 | 7/2012 | Lustiger |
| 8,343,553 | B2 | 1/2013 | Hospodor |
| 8,485,052 | B2 | 7/2013 | Gebhart |
| 8,676,390 | B2 | 3/2014 | Berry, Jr. |
| 8,690,087 | B2 | 4/2014 | Holl |
| 8,734,143 | B2 | 5/2014 | Morris |
| 8,842,267 | B2 | 9/2014 | Heine |
| 8,955,397 | B2 | 2/2015 | Saari |
| 9,066,910 | B2 | 6/2015 | Rosenblatt |
| 9,104,650 | B2 | 8/2015 | Hosek |
| 9,126,249 | B2 | 9/2015 | Beneditti |
| 9,498,779 | B2 * | 11/2016 | Brendler ..... B30B 3/04 |
| 9,533,335 | B2 | 1/2017 | Vedova |
| 9,604,226 | B2 | 3/2017 | Storm |
| 9,649,349 | B1 | 5/2017 | Tucker |
| 9,651,467 | B2 | 5/2017 | Deguchi |
| 9,694,040 | B2 | 7/2017 | Scialdone |
| 9,788,770 | B1 | 10/2017 | Belthangady |
| 9,795,338 | B2 | 10/2017 | Kang |
| 9,797,801 | B2 | 10/2017 | Batcheller |
| 9,797,822 | B2 | 10/2017 | Little, III |
| 9,801,956 | B2 | 10/2017 | Kularatne |
| 9,803,063 | B2 | 10/2017 | Reddy |
| 9,804,092 | B2 | 10/2017 | Zeng |
| 9,808,538 | B2 | 11/2017 | Kularatne |
| 9,841,265 | B2 | 12/2017 | Hunter |
| 9,919,315 | B2 | 3/2018 | Pearson |
| 9,959,514 | B2 | 5/2018 | Phan |
| 9,974,821 | B2 | 5/2018 | Kennedy |
| 10,556,239 | B2 * | 2/2020 | Giesemann ..... B02C 23/18 |
| 10,569,280 | B2 * | 2/2020 | Busenhart ..... B02C 25/00 |
| 2002/0022899 | A1 | 2/2002 | Dehy |
| 2002/0168911 | A1 | 11/2002 | Tonner |
| 2003/0017426 | A1 | 1/2003 | Schmidt |
| 2003/0030565 | A1 | 2/2003 | Sakatani |
| 2004/0096585 | A1 | 5/2004 | Bonnebat |
| 2006/0073258 | A1 | 4/2006 | Korolchuk |
| 2006/0145881 | A1 | 7/2006 | Sakatani |
| 2006/0231021 | A1 | 10/2006 | Friske |
| 2007/0170291 | A1 | 7/2007 | Naganawa |
| 2007/0294121 | A1 | 12/2007 | Galt |
| 2008/0063330 | A1 | 3/2008 | Orlowski |
| 2008/0167483 | A1 | 7/2008 | Whittle |
| 2008/0203956 | A1 | 8/2008 | Cohen |
| 2008/0275660 | A1 | 11/2008 | Bhateja |
| 2009/0093191 | A1 | 4/2009 | Glide |
| 2009/0295561 | A1 | 12/2009 | Hu |
| 2010/0030926 | A1 | 2/2010 | Boussy |
| 2010/0059609 | A1 | 3/2010 | Teeter |
| 2010/0127217 | A1 | 5/2010 | Lightowlers |
| 2010/0176965 | A1 | 7/2010 | Fukumura |
| 2011/0067374 | A1 | 3/2011 | James |
| 2011/0276828 | A1 | 11/2011 | Tamaki |
| 2012/0005017 | A1 | 1/2012 | Lowden |
| 2012/0244266 | A1 | 9/2012 | Ku |
| 2013/0087644 | A1 | 4/2013 | Ephraim |
| 2013/0211737 | A1 | 8/2013 | Batcheller |
| 2013/0271110 | A1 | 10/2013 | Yamanaka |
| 2013/0301375 | A1 | 11/2013 | Stephan |
| 2014/0014748 | A1 | 1/2014 | Zeeck |
| 2014/0048459 | A1 | 2/2014 | Hafford |
| 2014/0145018 | A1 | 5/2014 | Niklewski |
| 2014/0245799 | A1 | 9/2014 | Kim |
| 2014/0299688 | A1 | 10/2014 | Carbonini |
| 2015/0129698 | A1 | 5/2015 | Olson |
| 2015/0211971 | A1 | 7/2015 | Little, III |
| 2015/0300800 | A1 | 10/2015 | Van Valkenburgh |
| 2015/0324759 | A1 | 11/2015 | Bansal |
| 2015/0346717 | A1 | 12/2015 | Hosek |
| 2016/0107162 | A1 | 4/2016 | Busenhart |
| 2017/0080466 | A1 | 3/2017 | Godwin |
| 2017/0131194 | A1 | 5/2017 | Little, III |
| 2017/0333257 | A1 | 11/2017 | Schmitz |

FOREIGN PATENT DOCUMENTS

| | | |
|---|---|---|
| DE | 102005055373 | 5/2007 |
| EP | 0180816 | 5/1986 |
| EP | 1195668 | 9/2002 |
| JP | 59191511 | 10/1984 |
| JP | 1071410 | 3/1998 |
| WO | 2005119089 | 12/2005 |
| WO | 2007066847 | 6/2007 |

(56) References Cited

FOREIGN PATENT DOCUMENTS

| | | |
|---|---|---|
| WO | 2009083096 | 7/2009 |
| WO | 2010082322 | 7/2010 |
| WO | 2012145846 | 11/2012 |
| WO | 2017051398 | 3/2017 |
| WO | 2018036978 | 3/2018 |

* cited by examiner

SYSTEMS AND METHODS FOR MONITORING THE ROLL DIAMETER AND SHOCK LOADS IN A MILLING APPARATUS

REFERENCE TO RELATED APPLICATIONS

This application claims the benefit of U.S. Provisional Application No. 62/703,682 filed Jul. 26, 2018 which is hereby incorporated by reference in its entirety.

BACKGROUND

Field

The present disclosure relates to milling apparatus and more particularly pertains to new systems and methods for monitoring the roll diameter and shock loads in a milling apparatus.

SUMMARY

In one aspect, the disclosure relates to a particle grinding system comprising a frame, a pair of rolls including a movable first roll and a second roll, roll supports configured to support the first roll on the frame in a movable manner and the second roll on the frame, a motor assembly configured to rotate at least one of the rolls, and a wear sensing assembly configured to detect wear on at least one of the rolls of the pair of rolls.

In another aspect, the disclosure relates to a particle grinding system comprising a frame, a pair of rolls including a movable first roll and a second roll, roll supports configured to support the first roll on the frame in a movable manner and the second roll on the frame, a motor assembly configured to rotate at least one of the rolls, and a shock sensing assembly configured to detect shock to at one of the rolls.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
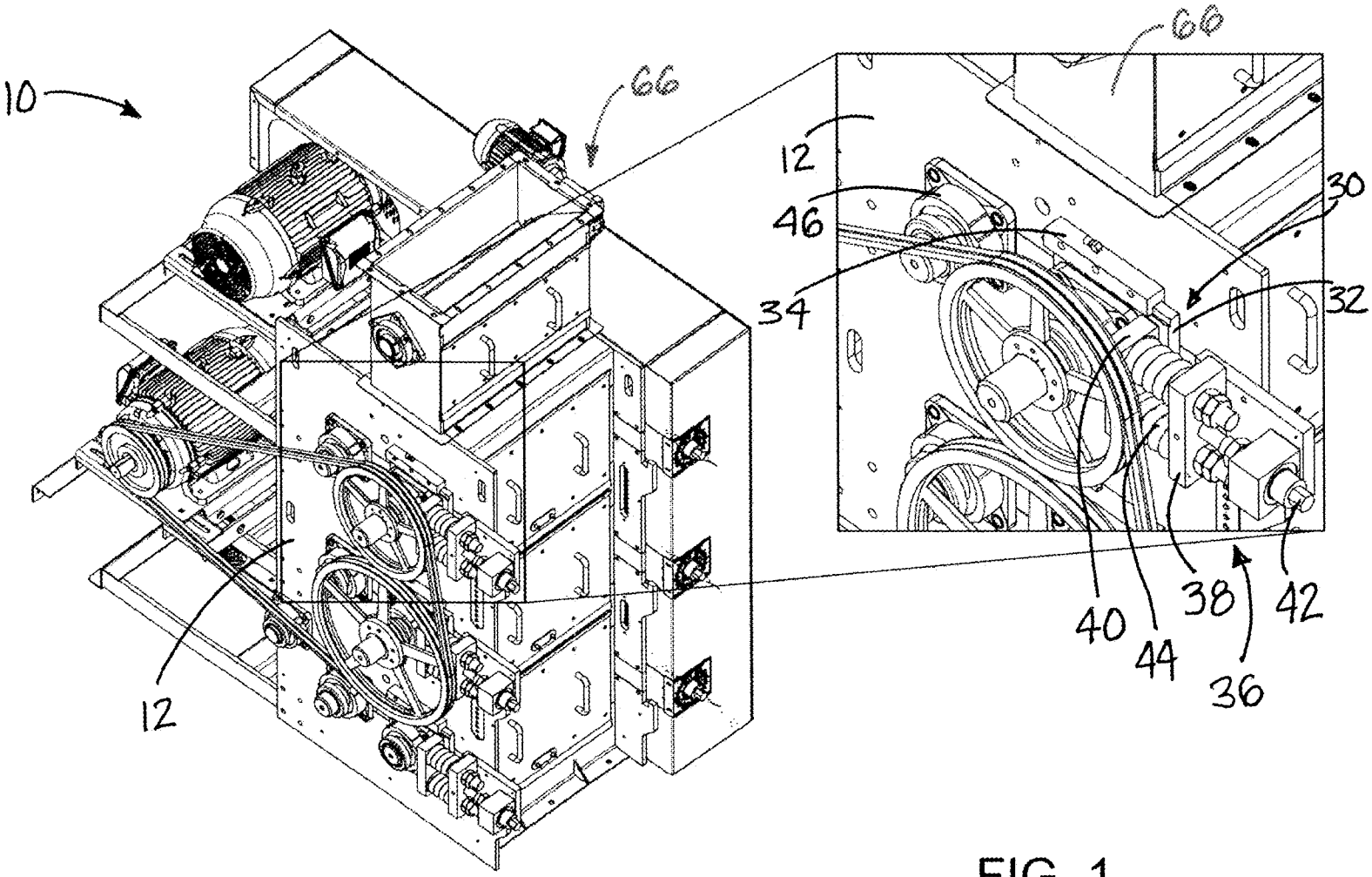
FIG. 1 is a schematic perspective view of an illustrative grinding apparatus suitable for employing the new roll adjustment system according to the present disclosure.
Figure 2:
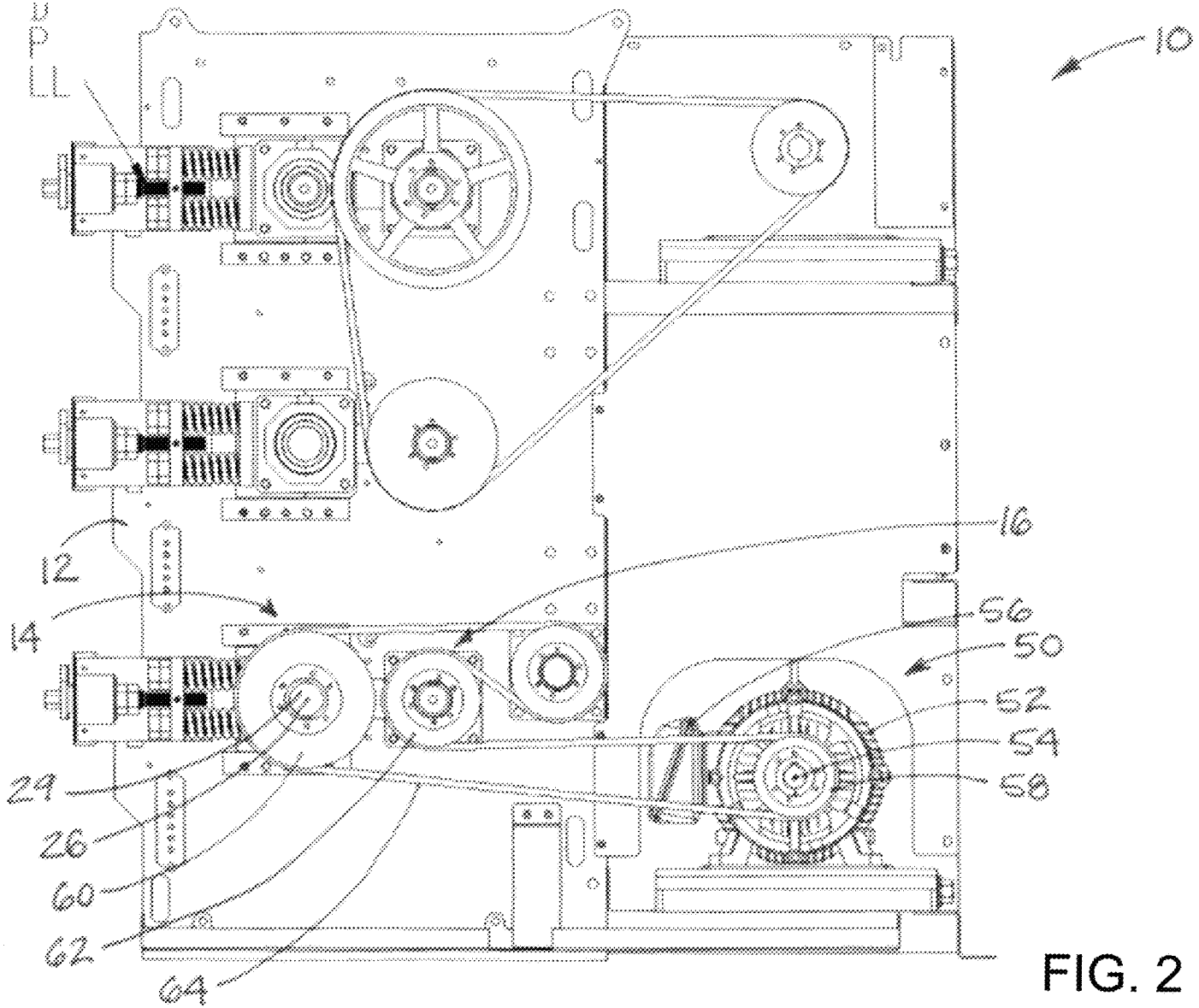
FIG. 2 is a schematic side view of a grinding apparatus with the new roll adjustment system, according to an illustrative embodiment.
Figure 3A:
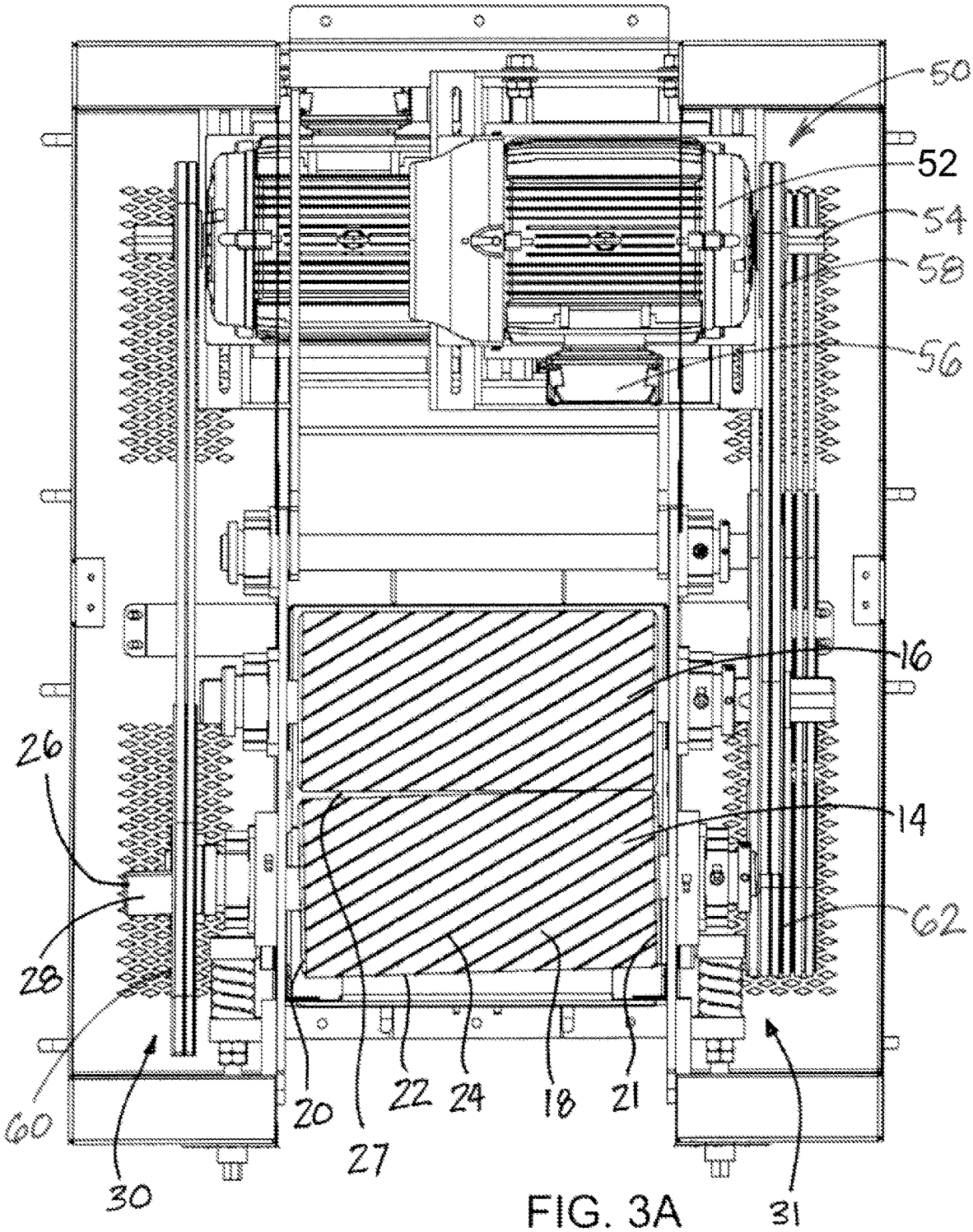
FIG. 3A is a schematic sectional view of the grinding apparatus with the roll adjustment system, according to an illustrative embodiment, with one end of the movable roll in a zero position with respect to the stationary roll and thus completing a circuit.
Figure 3B:
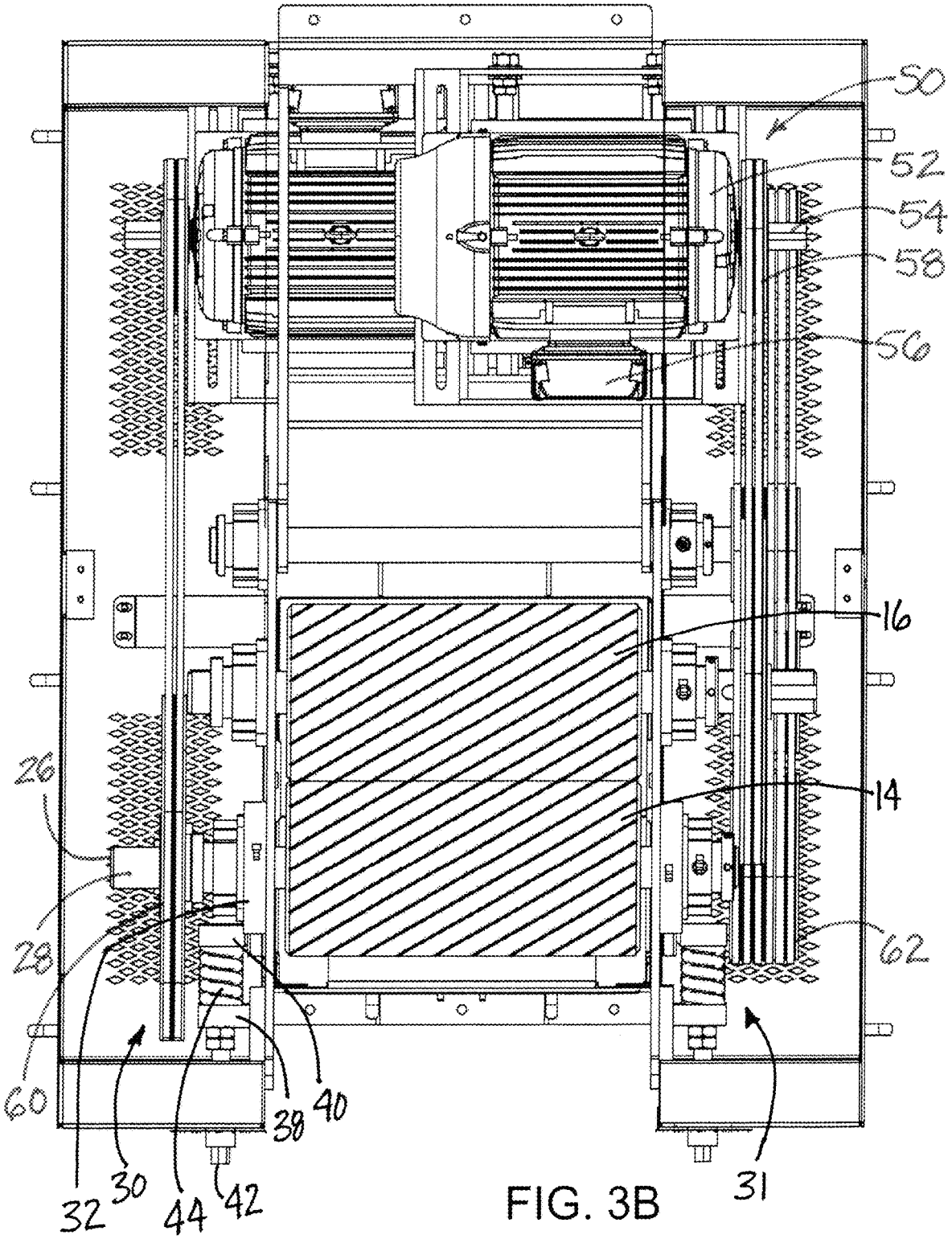
FIG. 3B is a schematic sectional view of the grinding apparatus with the roll adjustment system, according to an illustrative embodiment, with both ends of the movable roll in a zero position with respect to the stationary roll and thus completing a circuit.
Figure 3C:
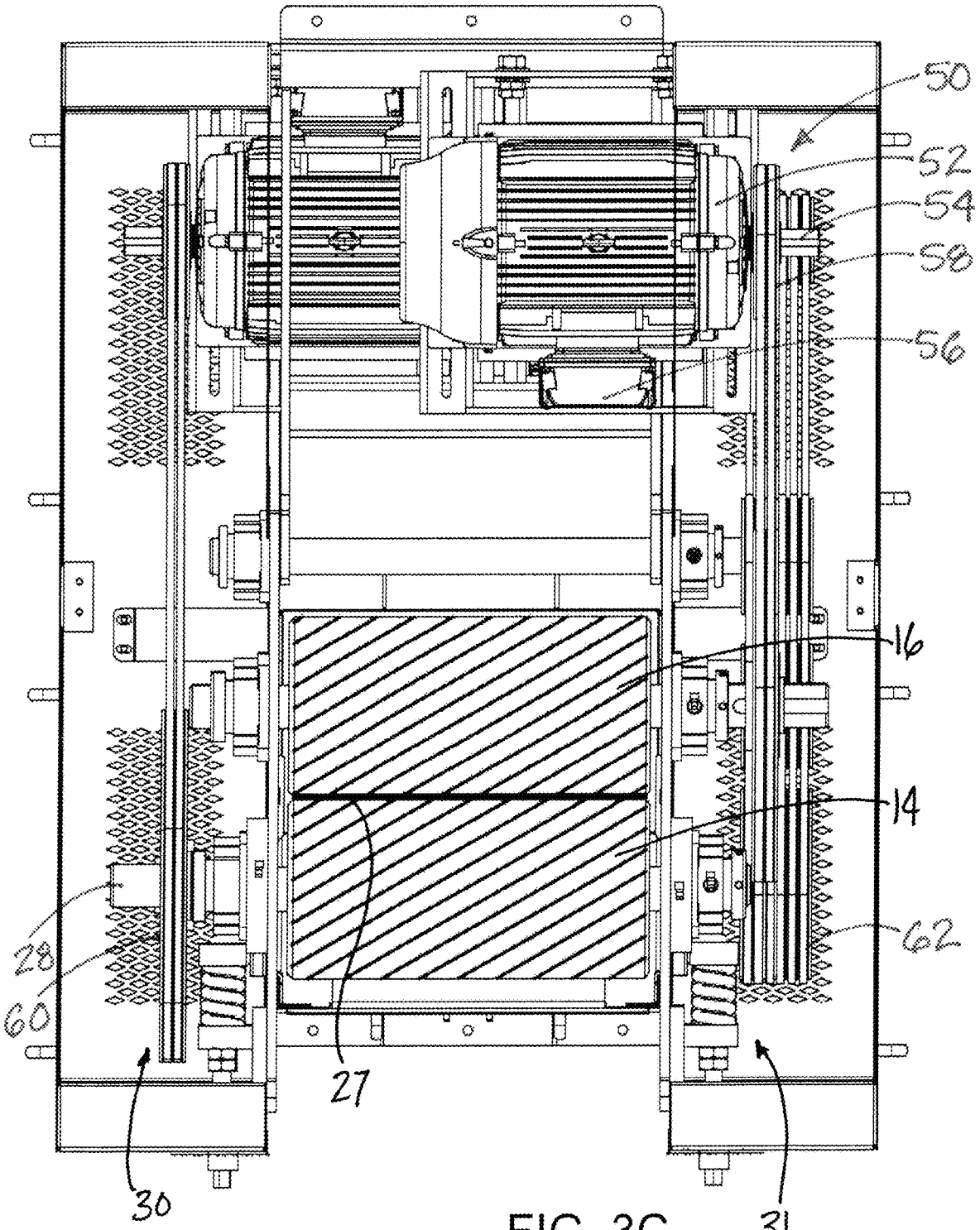
FIG. 3C is a schematic sectional view of the grinding apparatus with the roll adjustment system, according to an illustrative embodiment, with the movable roll separated by a uniform separation gap from the stationary roll and thus not completing the circuit.
Figure 4:
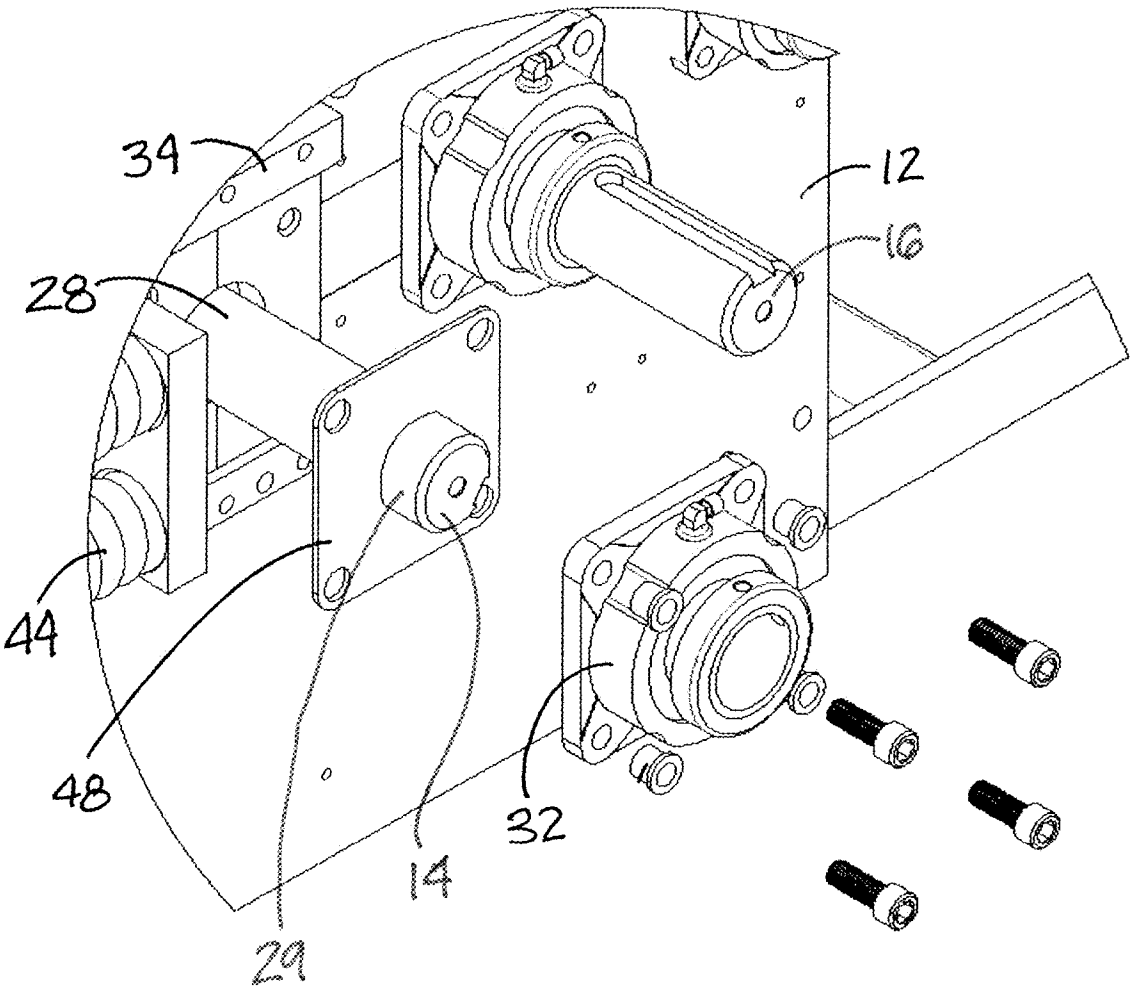
FIG. 4 is a perspective view of a portion of the system including an end portion of the first roll and the respective roll support with elements of the isolating assembly.
Figure 5:
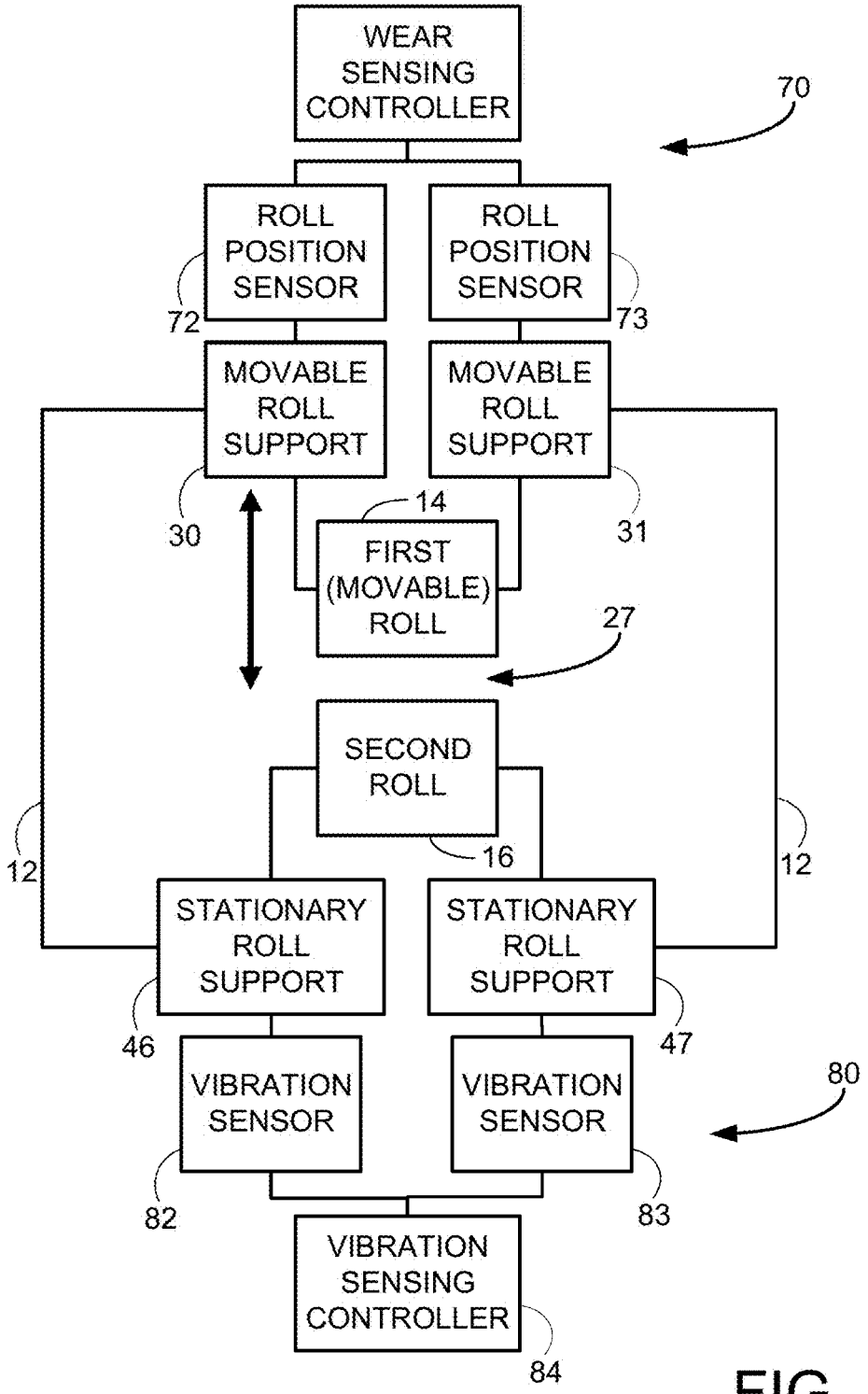
FIG. 5 is a schematic diagram of elements of the system, according to the present disclosure.
Figure 6:
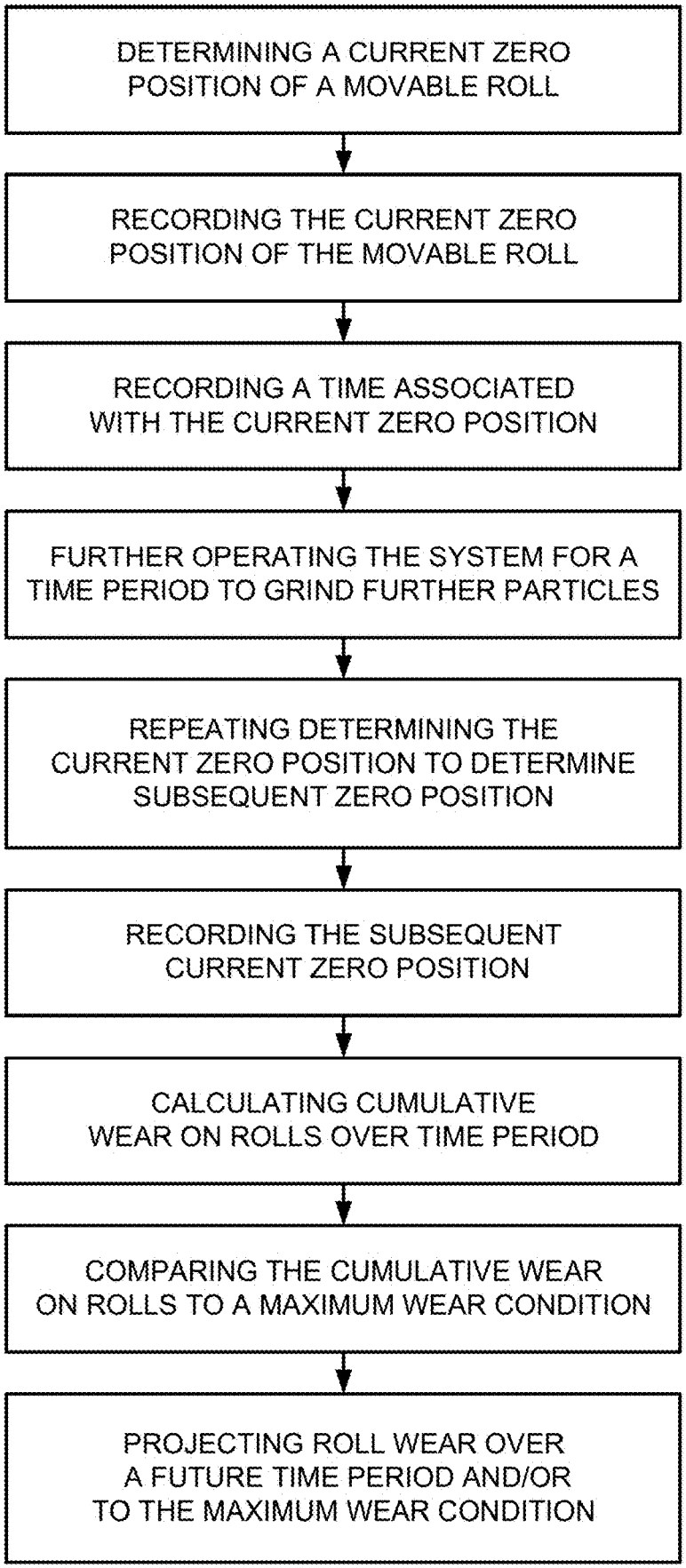
FIG. 6 is a schematic flow diagram showing one illustrative implementation of a method of the disclosure.
Figure 7:
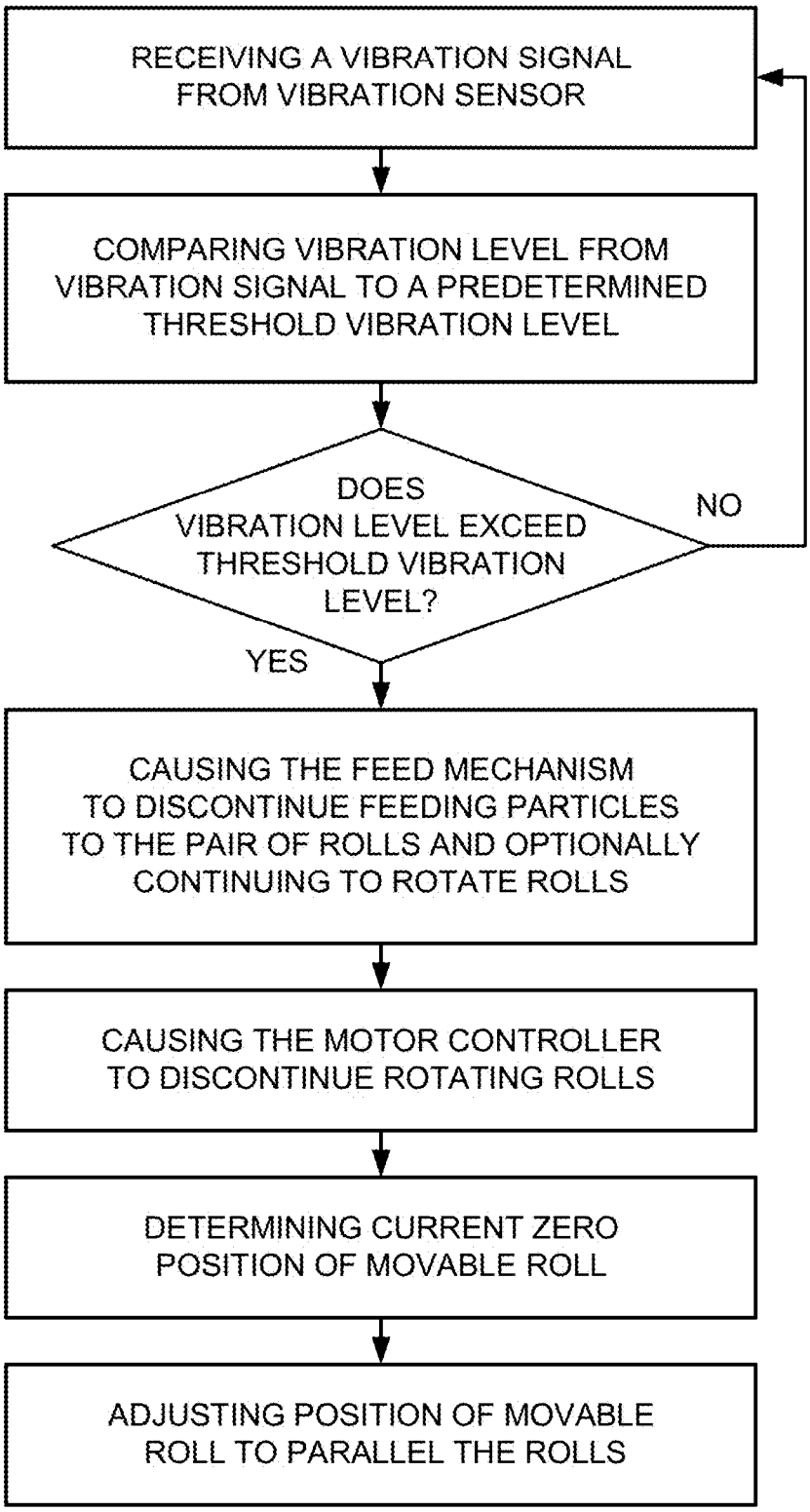
FIG. 7 is a schematic flow diagram showing one illustrative implementation of a method of the disclosure.
Figure 8:
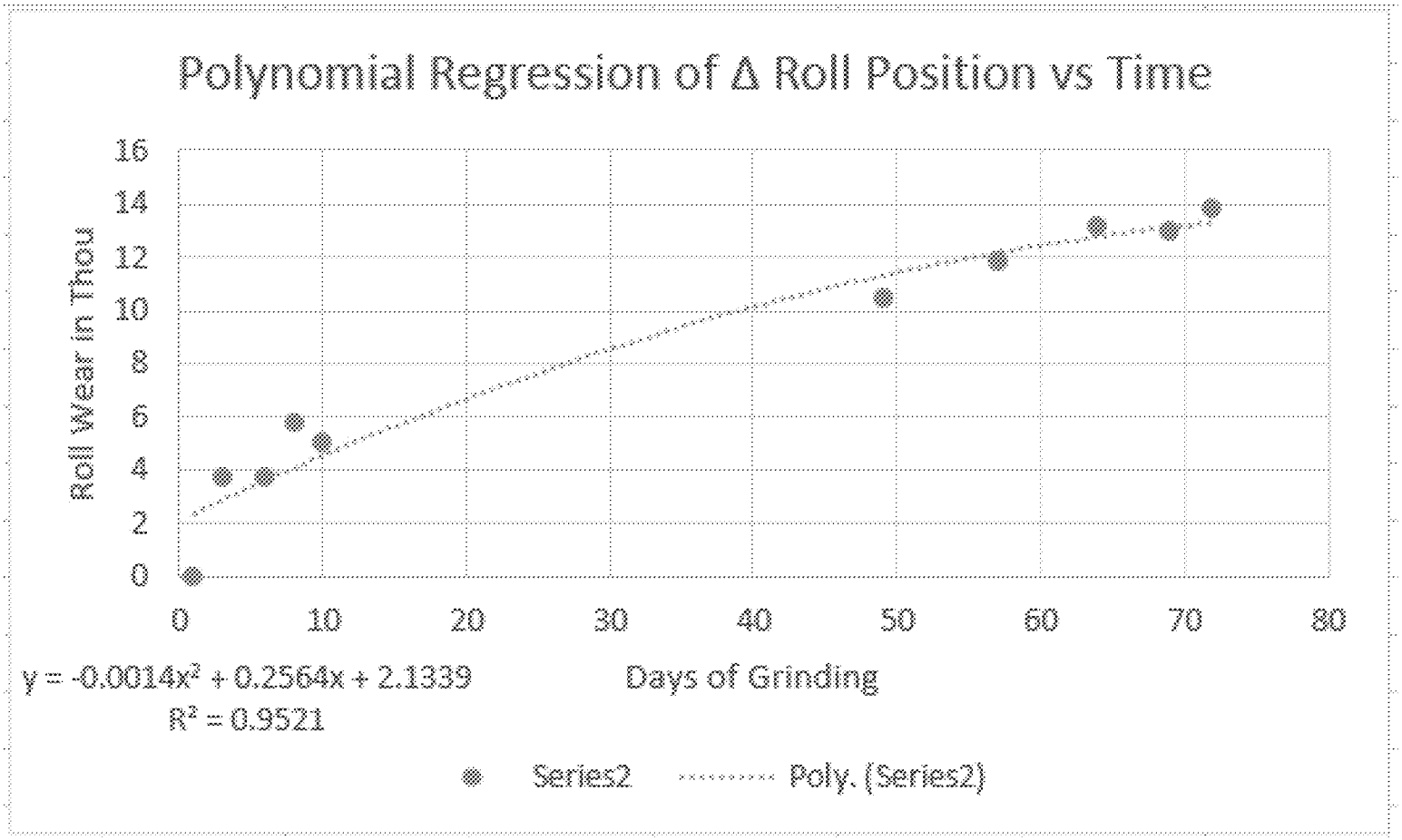
FIG. 8 is a schematic graphical representation of predicted wear calculations based upon observed wear on the rolls, according to an illustrative implementation

With reference now to the drawings, and in particular to FIGS. 1 through 8 thereof, a new system and method for monitoring the roll diameter and shock loads in a milling apparatus embodying the principles and concepts of the disclosed subject matter will be described.

The applicants have recognized that in the production of livestock feed, consistency in the particle size of the feed improves the efficiency of the feed for the livestock, such as in the manner in which the animal digests the feed. Particle size is determined at least partially by the size of the gap spacing between the closest portions of the rolls of the milling or grinding apparatus (such as the peaks of the teeth formed on the rolls), which is sometimes referred to as the nip point. The gap spacing typically changes over time as the material being ground moves through the gap, or nip, and wears material away from the rolls. As a result, the size of the gap may constantly increase as time passes and the milling apparatus operates to grind particles.

However, wear on the rolls usually compromises the ability to accurately adjust (and maintain) the size of the gap spacing since the dimeter of the roll of rolls is decreasing. Thus, the "zero gap" position of the movable roll, or the position of the roll when there is no gap between the rolls is affected by the reduction in the diameter of the rolls caused by wear. To increase the accuracy of adjustment of the gap size between the rolls, the "zero position" of the movable roll must be reestablished through a process of bringing the rolls together to identify the new position of the movable roll when the gap is zero or nonexistent, and usually also involves bringing the rolls into a parallel orientation so that the width of the gap is made as uniform as possible along the length of the rolls.

The applicants have also recognized that wear of the teeth can cause at least two problems in the operation of a milling apparatus. Due to the wear, the geometry of the tooth profile on the rolls is dynamic and continues to change during operation of the milling apparatus. As the teeth wear and the profile of each tooth is diminished in a radial direction of the roll, the teeth tend to lose their ability to pull material through the gap between the rolls, and the milling apparatus in general, and consequently the milling capacity of the apparatus decreases. Further, the continuing change to the geometry of the tooth profile can cause "flaking" of the feed material as the dulled edge of the tooth tends to compress or "mash" the material more than the tooth is able to cut the material, and may produce drastic inconsistencies in the sizes of particles as some particles are cut by the teeth and other particles are flaked or mashed.

The diminished ability of the tooth profile to pull material through the nip can in some cases cause material to accumulate and sit on top of the rolls rather than passing through the nip or gap, a condition that is typically referred to as "flooding". The flooding of the rolls can be even more abrasive to the teeth on the rolls than running material through the nip as the accumulating material rubs on the teeth of the roll as the roll spins by the relatively stationary accumulated material, and as a result can increase the wear of the rolls at an even faster rate than normal.

In current practice, the operator of the milling apparatus typically only becomes aware that a change out of worn rolls is necessary when he or she notices a drop in the throughput of the apparatus and/or the occurrence of flaking of the milled material. The unpredictability of when wear on the rolls will necessitate re-sharpening of the rolls can therefore lead to a period of apparatus operation (before discovery) at a suboptimal performance level.

The applicants have realized that the current practice represents a reactive approach as the need to change out the rolls is only determined when problems resulting from excess wear are discovered by the operator. Until the operator makes this discovery, the milling apparatus may not be operating at full capacity and may be producing feed material with inconsistent grinding characteristics causing a loss in feed efficiencies.

In an attempt to be more proactive, one approach has been to have the operator keep track of the volume of material passing through the milling apparatus to attempt to predict when a roll change will be needed based upon, for example, the manufacturer's recommendations. However, this approach doesn't take into account how hard the milling apparatus has been operated and variations in the material that can increase or decrease wear, such as the moisture level and temperature of the material, the specific type of material, and the magnitude of the size reduction occurring in the milling apparatus, as well as other factors and conditions that may produce premature and unexpected degrees of wear of the teeth on the mill roll.

Predictability of when the maximum wear on the pair of rolls will occur is often complicated by the characteristics of the teeth on the rolls, such as the number of grooves per inch (GPI) of circumference which is a relative measure of the density of teeth on the roll. Generally, lower or lesser GPI are typically classified as "coarse" and higher or greater GPI are typically classified as "fine." The lesser GPI rolls tend to have a greater groove depth dimension" and greater GPI tend to have a smaller groove depth dimension. Groove depth, and the corresponding tooth height, is classified as the length from the tip of a tooth to the bottom of the valley. The larger the groove depth, generally the more wear a roll can experience before needing to be removed for maintenance. Additionally, a milling apparatus may include multiple pairs or "sets" of rolls with different teeth characteristics and GPIs. For example, a roller mill with three sets of rolls has six rolls in total and each roll may have a different GPI, thereby producing six different GPIs for the apparatus.

The applicants have further recognized that the recurring recalibrations of the zero position of the movable roll of the pair of rolls, which is typically made necessary by the wear on the rolls, may provide an indication of the degree of wear exhibited by the rolls, and may also provide an indication of the need to replace the rolls prior to the occurrence (and observation) of the aforedescribed negative effects of excess wear on the rolls (e.g., loss of capacity and material flaking), and may also provide a predictive measure of wear likely to occur on the rolls in the future.

The applicants have thus developed a method of tracking changes in the diameter of a roll using the change in the relative zero positions of the rolls over a given time period in a roller mill apparatus when a series of recalibrations of the zero positions are performed as the rolls wear, which can be performed remotely from the mill apparatus and may also be performed in real time.

In greater detail, one or more sensors may sense the position of the moveable roll at any desired time, and most significantly at the time when the roll is determined to be located at the current zero position for the roll, which may be a first or initial zero position tracked for the apparatus. The record or history of the zero positions for the movable roll may be tracked as the rolls wear and a new zero position may be periodically determined and recorded. The change in the relative zero position of the roll generally corresponds to the loss of material from the teeth of the roll or rolls due to wear, and the corresponding decrease in the diameter of the roll or rolls from wear. Changes in the zero position of the movable roll may reflect a combination of the wear experienced by one roll or both rolls of the pair of rolls.

When a new relative zero position (which may be second zero position for the purpose of tracking) is established and identified through the process for establishing the zero positon (which may also include bringing the rolls in a parallel relationship), the change in zero position is tracked and logged and the degree of wear is calculated. Subsequent zero positions (e.g., third, fourth, etc.) may also be determined and logged. The calculated wear may be compared to the value of a predetermined point of maximum wear to determine if replacement is required, the current percent of life remaining may be updated, and a new prediction of life or time before the rolls reach the diameter of maximum wear, may be produced through a predictive algorithm.

Illustrative systems 10 that may be suitable for the implementation of the aspects of the disclosure may include a frame 12 and a pair of rolls 14, 16 mounted on the frame in a manner permitting rotation of the rolls. While suitable systems may include more than one pair of the rolls, for the purposes of this description a single pair of rolls will be described with the understanding that additional pairs of rolls of a system may utilize multiple similar or identical elements. The pair of rolls may include a first roll 14 and a second roll 16 that are generally oriented substantially parallel to each other and may rotate in the same or opposite rotational directions. Each of the rolls 14, 16 may include a roll body 18 with opposite ends 20, 21 and a circumferential surface 22 extending between the ends 20, 21. Typically the circumferential surface 22 is substantially cylindrical in shape, and includes a plurality of teeth 24 that are formed on the circumferential surface which protrude outwardly to some degree from the surface 22 and are effective for the grinding or otherwise processing the material moving through the system 10. In some embodiments the teeth 24 extend from the first end 20 to the second end 21, and may be substantially straight between the opposite ends 20, 21, and may be substantially continuous between the ends, although the particular form of the teeth is not necessarily critical to the disclosure and other teeth configurations may be employed.

Each of the rolls 14, 16 may also include a roll shaft 26 that may extend through the roll body 18 and have end portions 28 which are exposed and extend from the opposite ends 20, 21 of the roll body. The end portions 28 of the roll shaft 26 may have a substantially cylindrical shape that is suitable for being journalled in a bearing for rotation with respect to the bearing.

In illustrative embodiments of the system 10, one of the rolls may be a stationary roll which is mounted to the frame 12 in a manner such that the stationary roll is substantially immovable and unable to engage in translation movement with respect to the frame (and the other roll) during normal use of the system, while still being able to move rotationally. The other one of the rolls may be a movable roll which is mounted on the frame in a manner that permits translation movement with respect to the frame and the stationary roll, while also being able to rotate. Although this is a preferred configuration for the purpose of greater simplicity, it is possible that both of the rolls may be mounted on the frame in a manner that permits both rolls to move in translational motion with respect to the frame. The movable roll is thus movable with respect to the frame, but is also movable with respect to the stationary roll such that the movable roll is able to move toward and away from the stationary roll to adjust a size and character of a separation gap 27 between the rolls.

In some embodiments, the movable roll may be mounted on the frame 12 in a manner that permits independent movement of the ends 20, 21 with respect to the stationary roll, and also with respect to the frame, so that the magnitude of the separation gap may vary between the ends. In the illustrative embodiments of this description, the first roll 14 forms the movable roll and the second roll 16 forms the stationary roll.

The system may also include one or more roll supports, with each roll support receiving one of the end portions 28 of one of the roll shafts 14, 16 to thereby support the respective roll body on the frame in the indicated manner (e.g., movable or stationary). Each of the roll supports may include a bearing or other suitable structure for supporting a portion of a rotating shaft. The roll supports may include at least one movable roll support assembly 30 for supporting the roll shaft of the movable roll on the frame, and in embodiments a pair of movable roll support assemblies 30, 31 may be employed with each assembly supporting one of the end portions 28 of the roll shaft of the movable roll 14. The movable roll support assemblies 30, 31 may be movably mounted on the frame to permit movement of the movable roll toward and away from the stationary roll to thereby change and adjust the size of the separation gap 27 between the rolls 14, 16.

Illustratively, each of the movable roll support assemblies 30, 31 may include a bearing block 32 which is movably mounted on the frame, and may be slidably mounted on the frame by one or more guides 34 mounted on the frame that effectively form a track for the bearing block to move toward and away from the stationary roll 16. The movable roll support assemblies 30, 31 may also include an adjustment structure 36 which is configured to adjust a position of the bearing block with respect to the stationary roll 16 and also with respect to the frame 12. An illustrative adjustment structure includes a stop 38 mounted on the frame 12, a brace 40 mounted on the bearing block 32, and an adjustment member 40 which is configured to move the brace with respect to the stop, and thereby move the bearing block with respect to the frame. A portion of the exterior of the adjustment member 42 may be threaded, and the threaded portion of the adjustment member may extend through a threaded hole in the brace 40 such that rotation of the adjustment member in a first rotational direction moves the brace toward the stop 38 and rotation of the adjustment member in a second rotational direction moves the brace away from the stop.

Each of the movable roll support assemblies 30, 31 may also include a biasing structure 44 which is configured to bias movement of the movable roll toward or away from the stationary roll 16, and may accomplish this through biasing the bearing block 32 toward or away from the roll 16. Illustratively, the biasing structure 44 may comprise a spring which is positioned between the stop 38 and the brace 40 to push the brace away from the stop and thereby urge the bearing block to move toward the stationary roll subject to the adjustment by the adjustment member 42.

The roll supports may also include a stationary roll support 46 for supporting the roll shaft 26 of the stationary roll 16. A pair of the stationary roll supports 46, 47 may be employed to support the respective opposite end portions of the roll shaft, and each may comprise a bearing mounted on the frame in a manner that is configured to hold the stationary roll 16 in a fixed position on the frame during normal operation of the system, such as by being directly bolted to the frame.

The system 10 may also include a motor assembly 50 which is configured to rotate at least one of the rolls, and in some implementations may rotate both of the rolls 14, 16. In other implementations, a separate motor assembly may be utilized to rotate each one of the rolls. The motor assembly 50 may include a motor 52 which may be mounted on the frame 12 and may have a motor shaft 54 which rotates upon the application of electrical power to the motor. In other implementations, the motor 52 may be operated by means other than electrical power, such as, for example, a fuel. The motor assembly 50 may also include a motor controller 56 which is configured to control the supply of power to the motor to thereby control the rotational speed of the motor shaft 54. A driver pulley 58 may be associated with the motor, and may be mounted on the motor shaft to be rotated by the shaft. A first driven pulley 60 may be associated with the first roll 14, and may be mounted on the roll shaft 26 of the first roll. A second driven pulley 62 may be associated with the second roll 16, and may be mounted on the roll shaft 26 of the second roll 16. A drive belt 64 may be entrained on the driver pulley 58 and the driven pulley or pulleys 60, 62 to transfer rotation of the driver pulley to the driven pulleys, and as a result from the motor to the rolls.

A feed mechanism 66 of the system 10 may be configured to feed particles (either directly or indirectly) to the pair of rolls 14, 16 to be ground by the rolls as the particles pass through the gap 27. The feed mechanism 66 may be caused to operate faster to supply a greater quantity of particles to the rolls, or operate slower to supply a lesser quantity of particles to the rolls, as well as being caused to stop operation to effectively stop feeding particles to the rolls and the gap 27.

The system 10 may include a wear sensing assembly 70 configured to detect wear on at least one of the rolls of the pair of rolls, and typically the collective wear on the pair of rolls. The wear sensing assembly 70 may include at least one roll position sensor 72 which is configured to sense a position of the movable first roll 14 when the first roll is determined to be in a zero position with respect to the second roll 16, which may be considered to be a first or current zero position based upon the current degree of wear on the rolls 14, 16 at the time the determination is made. The roll position sensor 72 may be configured to detect the position of one of the movable roll support assemblies 30, 31 with respect to the frame 12. In some embodiments, a pair of roll position sensors 72, 73 may be provided with each of the roll position sensors being configured to sense a current position of one of the respective movable roll support assemblies 30, 31 with respect to the frame.

The wear sensing assembly 70 may additionally include a wear sensing controller 74 which is configured to receive position information from the roll position sensor or sensors 72, 73 for at least one of the rolls, such as a movable roll 14. From the information received by the wear sensing controller 74, the controller may determine a current zero position for at least one of the rolls of the pair of rolls, usually a movable roll. Determining the current zero position of the movable roll may include moving the movable roll to the current zero position, which may be accomplished by moving the rolls 14, 16 together through moving the movable roll 14 towards the stationary roll 16, and detecting contact between the rolls 14, 16 to indicate that the movable roll is in the zero position. Suitable techniques for determining the current zero position of a movable roll are described, for example, in U.S. Pat. No. 9,919,315 and U.S. patent application Ser. No. 14/821,936, filed Aug. 10, 2015, both of which are hereby incorporated by reference in their entireties.

Further, data associated with the determination of the current zero position may be recorded by the controller 74, such as in a memory, and may include recording the current position information or signal received from the roll position sensor 72, 73 as the current zero position for the roll and may be recorded in a zero position log accessible by the controller 74. The current zero position data may be in the form of a dimension associated with the respective movable roll support assembly, and illustratively may comprise the relative location of the support bearing block 32 on the frame 12 along the bearing block guide 34. Time data associated with the current zero position of the roll may also be recorded and may be, for example, in the form of a time of operation of the milling apparatus from an initial time of operation of the apparatus with the particular rolls 14, 16 or with respect to some other reference point. Optionally, the time recorded could be an absolute time designation that has, for example, no reference to the operation of the system.

Further operation of the system may be commenced to mill or grind particles using the pair of rolls for a period of time after the time at which the zero position was determined. The time period may be a predetermined time period which is suitable for monitoring wear on the rolls. After the period of time is passed, the process of determining the zero position for the roll may be substantially repeated to determine a subsequent current (e.g., second) zero position for the roll after passage of the period of time. Recording of data associated with the subsequent current zero position may also be performed, such as the dimension associated with the subsequent zero position and the time associated with the determination of the subsequent current zero position. After further periods of operation of the system, determination of further (e.g., third, fourth, etc.) zero position locations and times may also be made and recorded. Additional zero position-related data may improve the accuracy of calculations and predictions provided by the system.

The wear sensing controller 74 may be configured to calculate various wear-related aspects using the data recorded with respect to the zero positions and the times associated with the zero positions. Illustratively, the current degree of wear, or cumulative current wear condition, on the rolls may be calculated, such as in relation to a previously-measured worn condition, such as the new or original or "unworn" condition of the pair of rolls. Cumulative current wear condition may be compared to a maximum cumulative wear condition for the pair of rolls, which may represent the maximum amount of wear on the rolls that is on the allowable before replacement or repair of the rolls is desirable or necessary. The maximum cumulative wear condition may represent the amount of wear that may occur to the rolls before the wear starts to cause problems, such as the aforementioned problems with moving the particles through the gap and/or flaking of the particles begins to occur.

Other calculations may include a prediction of the time period of operation of the milling apparatus between the current time with the cumulative current wear condition on the pair of rolls and a time in the future at which the maximum cumulative wear condition on the pair of rolls may occur The predictive wear calculations made of the wear sensing controller may be made using any approach or algorithm suitable to predict the wear, such as, for example, using machine learning, predictive modeling, polynomial or quadratic regression or curve fitting, to name a few illustrative examples. Each time a new zero position dimension is measured and logged, wear predictions may be recalculated to update the predicted values to account for changing conditions of the rolls. As additional zero position dimensions are measured and utilized in the calculation, and the number of data points increases, the more accurate the algorithm becomes at predicting wear on the rolls, and predicting the time left to reach the maximum level of wear. The updated predictive wear calculations provided by the system may give the system operator an indication as to what factor(s) are affecting wear on the rolls and the approximate time period until the rolls reach the maximum cumulative wear level or condition.

Due to the geometry of the tooth profile, which widens closer to the base of the tooth and narrows toward the tip, the surface area of the outermost surface (e.g., the effective tip) of the tooth increases as more of the tooth profile is worn away from the roll. As a result, it takes more work (and operating time) to wear away the next increment of the tooth height than the work and operating time required to wear away the previous increment of tooth height. The most suitable algorithms may take into account this dynamic or changing nature of the surface area on the outermost surface of the tooth.

The system may be used on apparatus with multiple pairs of rolls (or roll sets) in which data points (i.e., zero position dimensions) from each roll set may be utilized in wear calculations for each roll set. Comparison between the wear rates of the respective roll sets may assist an operator or operation apparatus in detecting uneven wear between the roll sets of the milling apparatus, which may occur if roll sets are not utilized most effectively and in balance during operation of the apparatus.

The system may also be configured to detect uneven or non-uniform wear on a pair of rolls by monitoring and comparing changes in the individual zero position dimensions sensed by the individual roll position sensors 72, 73. Uneven wear on the rolls may be detected by changes in the zero position dimension varying from one roll position sensor to the other roll position sensor, particularly if the variation tends to increase as additional current zero position dimensions are determined. Uneven wear on the rolls may be a symptom of uneven feeding of the particles to the gap between the pair of rolls or if the gap becomes plugged with particles at one point along the lengths of the pair of rolls but remains clear along other portions of the lengths.

The system 10 may also include a shock sensing assembly 80 which is configured to detect or identify shocks or vibrations of relatively great magnitude to elements of the system, such as the pair of rolls 14, 16. Such shocks may result from, for example, foreign objects relatively larger than the gap width moving through the system and into the gap between the pair of rolls, causing the rolls (and particularly the movable roll) to vibrate and be moved outwardly from each other in a violent or extreme manner.

The shock sensing assembly 80 may include at least one vibration sensor 82 which is mounted on the apparatus in a manner that permits the sensor to sense a vibration level associated with at least one of the rolls of the pair of rolls. The vibration sensor 82 may be associated with one of the roll supports supporting a roll on the frame 12. Illustratively, the vibration sensor may be associated with one of the roll supports supporting the stationary roll 16, although the vibration sensor may be associated with the supports for the movable roll. The vibration sensor 82 may be configured to generate a vibration signal which generally corresponds to a vibration level being sensed by the vibration sensor. In some embodiments, a pair of vibration sensors 82, 83 may be employed with each of the vibration sensors being associated with one of the roll supports for a roll.

The shock sensing assembly 80 may further include a vibration sensor controller 84 which is in communication with the vibration sensor or sensors 82, 83 to receive a vibration signal or signals from the respective sensors. The vibration sensor controller 84 may be in communication with the motor controller 56 as well as other elements of the system such as the feed mechanism 66. Memory may be associated with the vibration sensor controller 84 for the purpose of recording vibration events which are detected by the vibration sensors and communicated to the controller via the vibration signal.

A method of operation by the vibration sensor controller 84 may include receiving a vibration signal from one or more of the vibration sensors to indicate vibration levels sensed by the sensors. The vibration sensor controller 84 may determine if the vibration level associated with the vibration signal is greater than a predetermined threshold vibration level which may indicate a shock load has been experienced by one or both of the rolls. In some implementations, if the vibration level associated with the vibration signal is greater than the predetermined threshold vibration level, then the vibration sensor controller may cause the feed mechanism 66 to discontinue feeding particles to the pair of rolls, and may include continuing to operate the motor assembly 50 to rotate the pair of rolls for the purpose, for example, of determining and sensing a further vibration level of the rolls without the passage of particles through the gap to potentially determine if the roll(s) are out of balance from damage. In some further implementations, sensing a vibration level greater than the predetermined threshold vibration level may cause the vibration sensor controller 84 to cause the motor controller 56 to discontinue operation of the motor 52 and thereby discontinue rotation of the pair of rolls and shutting down machine operation for damage assessment.

In some implementations, determining by the vibration sensor controller 84 that the vibration level is greater than the predetermined threshold vibration level may cause the vibration sensor controller 84 to cause the system to take steps to determine the current zero position of the movable roll, and may also cause the system to attempt to reestablish a parallel condition between the rolls and thereby reestablish a uniform gap between the rolls to correct any misalignment of the rolls with respect to each other if the misalignment exists due to, for example, the pair of rolls being exposed to a shock load.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A particle grinding system comprising:

a frame;

a pair of rolls including a movable first roll and a second roll;

roll supports supporting the first roll and the second roll on the frame, the roll supports including at least one movable roll support assembly supporting the first roll on the frame in a movable manner;

a motor assembly configured to rotate at least one of the rolls; and a wear sensing assembly configured to detect wear on at least one of the rolls of the pair of rolls, the wear sensing assembly including:

at least one roll position sensor configured to sense a position of the movable first roll when the first roll is determined to be in a zero position with respect to the second roll; and a wear sensing controller configured to receive current zero position data from the at least one roll position sensor including current zero position data, the wear sensing controller being configured to execute a set of instructions to:

determine a first zero position for the movable first roll of the pair of rolls from the current zero position data received at a first time from the at least one roll position sensor;

recording data associated with the determination of the first zero position including a first zero position dimension and the first time associated with the determination of the first zero position; and after further operation of the system for a time period grinding particles using the pair of rolls, determining a second zero position for the first movable roll from the current zero position data received at a second time from the at least one roll position sensor;

recording data associated with the determination of the second zero position including a second zero position dimension and the second time associated with the determination of the second zero position; and calculate a current wear condition of the pair of rolls at the second time with respect to a previous wear condition of the pair of rolls at the first time based upon any difference between the first zero position and the second zero position; and calculate a predicted time period of operation between the second time with the current wear condition on the pair of rolls and a future time in which the pair of rolls have a maximum cumulative wear condition for the pair of rolls.

2. The system of claim 1 wherein the second roll is stationary and the roll supports support the second roll on the frame in a stationary manner.

3. The system of claim 1 wherein the at least one roll position sensor is configured to detect a position of the at least one movable roll support assembly with respect to the frame.

4. The system of claim 1 wherein the roll supports include a pair of movable roll support assemblies each supporting an end of the first roll on the frame in a movable manner; and wherein the at least one roll position sensor comprising a pair of roll position sensors with each of the roll position sensors being configured to sense a positon of one movable roll support assembly of the pair of movable roll support assemblies with respect to the frame.

5. The system of claim 1 wherein the previous wear condition of the pair of rolls comprises an unworn condition of the pair of rolls.

6. A particle grinding system comprising:

a frame;

a pair of rolls including a movable first roll and a second roll;

roll supports and the second roll on the frame, the roll supports including a pair of movable roll support assemblies each supporting an end of the first roll on the frame in a movable manner;

a motor assembly configured to rotate at least one of the rolls; and a wear sensing assembly configured to detect wear on at least one of the rolls of the pair of rolls, the wear sensing assembly including:

a pair of roll position sensors with each of the roll position sensors being configured to sense a position of one movable roll support assembly of the pair of movable roll support assemblies with respect to the frame; and a wear sensing controller configured to receive current zero position data from the at least one roll position sensor including current zero position data, the wear sensing controller being configured to execute a set of instructions to:

determine a first zero position for each of the movable roll support assemblies from the current zero position data received at a first time from each of the roll position sensors associated with the movable roll support assemblies;

record data associated with the determination of the first zero position including a first zero position dimension for each of the movable roll support assemblies and the first time associated with the determination of the first zero position; and after further operation of the system for a time period grinding particles using the pair of rolls, determine a second zero position for each of the movable roll support assemblies from the current zero position data received at a second time from each of the roll position sensors associated with the movable roll support assemblies;

record data associated with the determination of the second zero position including a second zero position dimension for each of the movable roll support assemblies and the second time associated with the determination of the second zero position; and determine any differences between changes in the first and second zero positions of the respective movable roll support assemblies to detect differences between wear on the respective ends of the first roll.

7. A particle grinding system comprising:

a frame;

a pair of rolls including a movable first roll and a second roll;

roll supports configured to support the first roll on the frame in a movable manner and the second roll on the frame;

a motor assembly configured to rotate at least one of the rolls; and a shock sensing assembly for detecting shock to at least one of the rolls, the shock sensing assembly including at least one vibration sensor connected to at least one of the roll supports of the at least one roll to sense a vibration level transmitted to the at least one roll support by the at least one roll.

8. The system of claim 7 wherein the second roll is stationary and the roll supports support the second roll on the frame in a stationary manner, the at least one vibration sensor being connected to the at least one roll support supporting the second roll in a stationary manner.

9. The system of claim 7 wherein the at least one vibration sensor is connected to the at least one roll support separate of a connection of the at least one roll to the at least one roll support supporting the at least one roll.

10. The system of claim 7 wherein the at least one vibration sensor is directly connected to at least one of the roll supports supporting the at least one roll.

11. The system of claim 7 wherein the at least one vibration sensor comprises a pair of vibration sensors, each vibration sensor of the pair of vibration sensors being associated with one of the roll supports for the at least one roll.

12. The system of claim 7 wherein the at least one vibration sensor being configured to generate a vibration signal corresponding to a vibration level sensed by the vibration sensor; and wherein the shock sensing assembly includes a vibration sensor controller in communication with the at least one vibration sensor to receive the vibration signal from the at least one vibration sensor.

13. The system of claim 12 wherein the vibration sensor controller is configured to detect and record shock events detected by the at least one vibration sensor and communicated to the vibration sensor controller via the vibration signal.

14. The system of claim 7 wherein the at least one vibration sensor is configured to produce a vibration signal, and the shock sensing assembly additionally comprises a vibration sensor controller in communication with the at least one vibration sensor, the vibration sensor controller being configured to execute a set of instructions to:

receive a vibration signal from the at least one vibration sensor corresponding to vibration of the roll associated with the vibration sensor; and determine if the vibration level associated with the vibration signal is greater than a threshold vibration level indicating a shock load on the roll.

15. The system of claim 14 wherein the vibration sensor controller is configured to execute a set of instructions to:

if the vibration level associated with the vibration signal is greater than the threshold vibration level, cause a feed mechanism to discontinue feeding particles to the pair of rolls.

16. The system of claim 15 wherein the vibration sensor controller is configured to execute a set of instructions to:

if the vibration level associated with the vibration signal is greater than the threshold vibration level, cause a motor controller of the motor assembly to discontinue operation of a motor of the motor assembly rotating the at least one roll.

17. The system of claim 15 wherein the vibration sensor controller is configured to execute a set of instructions to:

if the vibration level associated with the vibration signal is greater than the threshold vibration level, then:

cause a motor controller of the motor assembly to continue to operate a motor of the motor assembly to rotate the at least one roll; and adjust positions of the ends of the movable first roll to reestablish a parallel condition between the pair of rolls and a uniform gap between the rolls across the length of the rolls.

* * * * *